US009903358B2

(12) United States Patent
Hernandez et al.

(10) Patent No.: US 9,903,358 B2
(45) Date of Patent: Feb. 27, 2018

(54) PORTABLE AIR COMPRESSOR

(71) Applicant: ALLTRADE TOOLS LLC, Long Beach, CA (US)

(72) Inventors: Hector Ray Hernandez, Fullerton, CA (US); Dale Harder, Placentia, CA (US); David Tarashandegan, Winnetka, CA (US)

(73) Assignee: ALLTRADE TOOLS LLC, Cypress, CA (US)

( * ) Notice: Subject to any disclaimer, the term of this patent is extended or adjusted under 35 U.S.C. 154(b) by 190 days.

(21) Appl. No.: 14/679,813

(22) Filed: Apr. 6, 2015

(65) Prior Publication Data

US 2016/0290329 A1 Oct. 6, 2016

(51) Int. Cl.
*F04B 35/06* (2006.01)
*F04B 41/02* (2006.01)
*F04B 49/22* (2006.01)

(52) U.S. Cl.
CPC ..... *F04B 41/02* (2013.01); *F04B 35/06* (2013.01); *F04B 49/225* (2013.01)

(58) Field of Classification Search
CPC ..... F04B 49/225; F04B 2203/0202
USPC ..... 417/440, 441
See application file for complete search history.

(56) References Cited

U.S. PATENT DOCUMENTS 4,664,601 A * 5/1987 Uchida ..... F04C 28/06 417/27
6,120,260 A * 9/2000 Jirele ..... F04B 49/035 417/295
6,676,388 B2 * 1/2004 Lee ..... F04B 35/045 417/415
7,086,841 B2 * 8/2006 Cornwell ..... F04B 39/10 137/492.5
7,153,106 B2 * 12/2006 Cornwell ..... F04B 39/08 417/213
7,648,343 B2 * 1/2010 Cornwell ..... F04B 39/08 417/278
2004/0141862 A1 * 7/2004 Cornwell ..... F04B 39/08 417/441
2007/0154335 A1 * 7/2007 Cornwell ..... F04B 39/08 417/441
2010/0290929 A1 * 11/2010 Ohi ..... F04B 41/02 417/360

* cited by examiner

*Primary Examiner* — Patrick Hamo
(74) *Attorney, Agent, or Firm* — David J. Pitman; Fulwider Patton LLP

(57) ABSTRACT

An air compressor comprising an air intake unit for importing air at atmospheric pressure. A cylinder means for compressing air; a storage tank; a first airline extending between the air intake unit and the cylinder means, the first airline being configured to convey air from the air intake unit into the cylinder means; a second airline extending between the cylinder means and the storage tank, the second airline being configured to convey compressed air from the cylinder means to the storage tank; a motor connected to the cylinder means, configured for driving the cylinder means; a valve inserted into the first airline, the valve being configured to be adjustable between a closed condition and an open condition.

3 Claims, 5 Drawing Sheets

PORTABLE AIR COMPRESSOR

BACKGROUND

This application relates to mobile air compressors. Specifically, the application relates to systems for protecting air compressor motors from stalling and burnout under conditions in which the electric power supplied to an air compressor motor may fall below a rated or operational level.

Mobile air compressors are known in the building industry. Such compressors typically comprise an air intake protected by a filter. Air taken into the intake is passed down an airline to a cylinder with an oscillating piston which compresses the air, after which the compressed air is then passed down a further airline to a storage tank, or compressor tank. The cylinder, or compression means, is driven by a motor which is typically designed to operate at a rated voltage to conform with the potential difference which is typically available domestically. In the USA this is about 120 volts, but it differs from country to country. Air flow from the compressor tank passes along a final airline to quick connect coupler outlets, which in turn may be coupled to be operable with a variety of tools known in the art. The passage of air between the compressor tank and the chosen tool is regulated by a control knob which lies in the final line.

However, problems in the art beset users of air compressors. One problem arises when the compressor draws its electrical power from a cable that may be longer than 20 feet, sometimes even up to 100 feet. This situation frequently arises when a portable compressor is used on a building site. The power outlet is typically located at a fixed point on the site, but the compressor may be required at a location remote from the outlet. However, the impedance of a long power cable may be relatively high, and consequently may have the result that the voltage, or potential difference, available to the compressor is diminished and is not the same as the voltage available at the power outlet. Accordingly, it is also not the same as the rated voltage under which the motor is designed to operate. This tends to have the undesirable result that the motor tends to stall during operation. Being an induction motor, rather than slowing down it continues at about the same speed as under the design or rated voltage, but tends to lose torque output and then to simply stall where the torque load is greater than the motor's torque output.

The same problem may arise due to different causes. For example it is found that cold weather may affect the voltage output at the end of an electric current cable, or it may reduce the torque deliverable by the motor.

This can be an exasperating experience to an operator, and there is presently no simple solution to this problem. As a result, expensive compressors may be found to be quite useless under certain conditions that arise fairly frequently.

Thus there is a need in the art for a compressor that addresses problems in the art. The present invention addresses these and other needs.

SUMMARY OF THE INVENTION

In one embodiment, the invention is an air compressor. The compressor comprises an air intake unit for importing air at atmospheric pressure. A means for compressing air is provided, and also a motor configured to drive the means for compressing air. A storage tank is provided, and a first airline is provided to extend between the air intake unit and the means for compressing air, the first airline being configured to convey air from the air intake unit into the means for compressing air. A second airline is provided to extend between the means for compressing air and the storage tank, the second airline being configured to convey compressed air from the means for compressing air into the storage tank. A valve is inserted into the first airline such that air in the first airline flows through the valve, the valve being configured to be adjustable between a condition of full air flow rate and a condition of reduced air flow rate. In some embodiments, the valve is configured to be manually adjustable by a user. In other embodiments, the motor is designed to operate under a rated potential difference, and the valve is configured to be adjustable by a means for adjustment that includes a micro-processing circuit. The means for adjustment is configured to measure a difference between the rated potential difference and an actual potential difference supplied to the motor. The means is for adjustment is configured to reduce a throat in the valve to reduce air flow through the valve by a certain amount, the certain amount being based on the difference between the rated potential difference and the actual potential difference supplied to the motor.

In another embodiment, the invention is a method for providing air to an air compressor having a motor designed to be run under a rated potential difference. The method comprises applying a potential difference to the motor thereby running the motor. Air is drawn at atmospheric pressure through a valve at a delivery rate of flow and is then transmitted to a means for compressing air. The air is compressed in the means for compressing air, and is then transmitted from the means for compressing air to a storage tank. The valve is adjusted to decrease the delivery rate of flow. In some embodiments, adjusting the valve is performed manually by a user. In other embodiments, the method includes the further steps of measuring the potential difference applied to the motor, and comparing the measured potential difference with the rated potential difference and, in these embodiments, adjusting the valve to decrease the delivery rate of flow includes adjusting the rate of flow by an amount that is based on the difference between the rated potential difference and the potential difference supplied to the motor.

DETAILED DESCRIPTION OF SOME EMBODIMENTS

Figure 1:
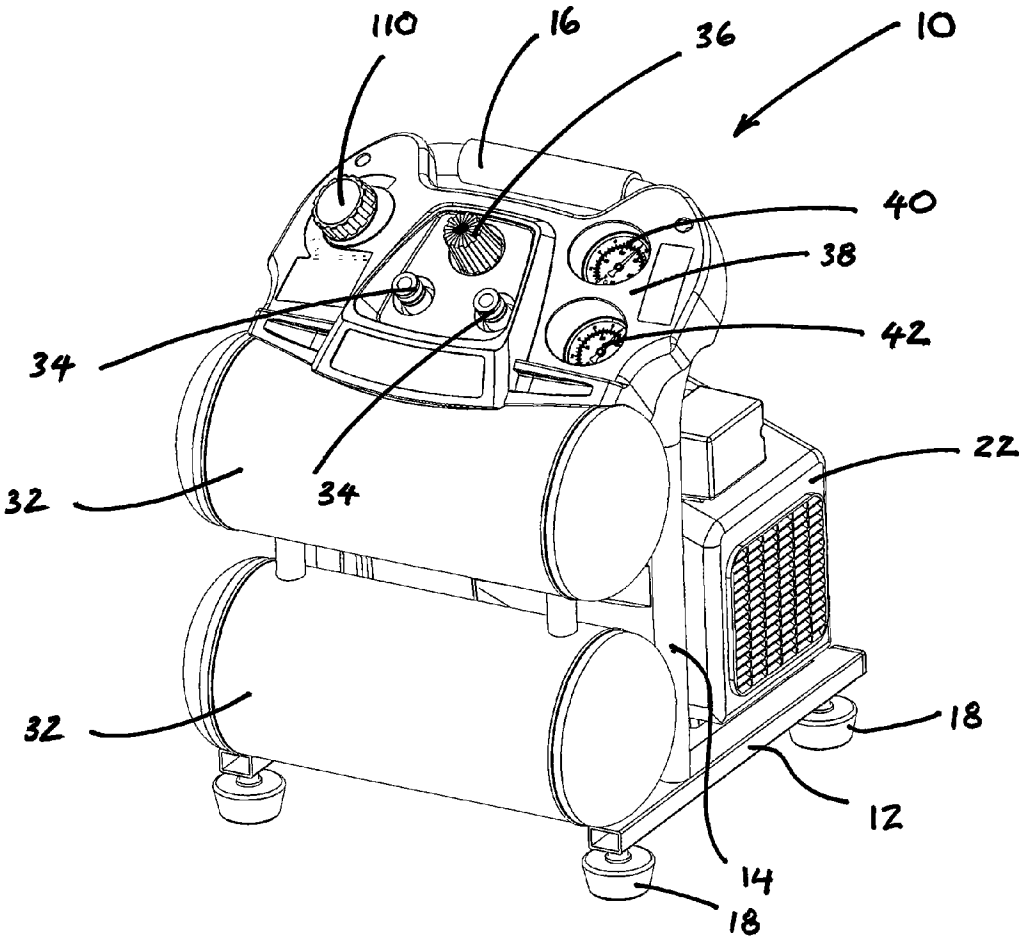
FIG. 1 is a front perspective view of a portable compressor having features of the invention.

An embodiment of the invention, which is described with reference to the figures, comprises a mobile air compressor 10 such as that exemplified in FIG. 1 and FIG. 2. A base frame 12 is provided, preferably made of metal tubing. Extending upwardly from the base frame is a handle frame 14 preferably formed from a metal tubing. At the apex of the handle frame is a handle 16, suitable for allowing an operator to lift the entire compressor 10 and move it to a desired location. The base frame may include feet 18, preferably rubber mounted on a threaded rod for height adjustment under known technology. Mounted on the frame is an electric motor 20, best seen in FIG. 2. The motor may be configured to operate on a rated voltage, typically 120 volts in the USA but it differs from country to country. A cover 22 may be provided to enclose the motor as seen in FIG. 1.

An air intake unit 24 (FIG. 2) is provided to receive an air filter, and to provide an aperture for receiving air at atmospheric pressure. Air passes through the intake unit 24 and travels via a first airline 26 or tube which is connected to a compression means or cylinder 28 which operates as an air pump, and enters the cylinder via a cylinder head 30. An oscillating piston (not seen in the figures) is located within the cylinder 28. The piston is set in oscillating motion by the motor 20 according to known technology, and this has the effect of compressing the air which is then passed via a second airline 44 (FIG. 4) into compressor tanks 32 where it is stored until needed.

Figure 4:
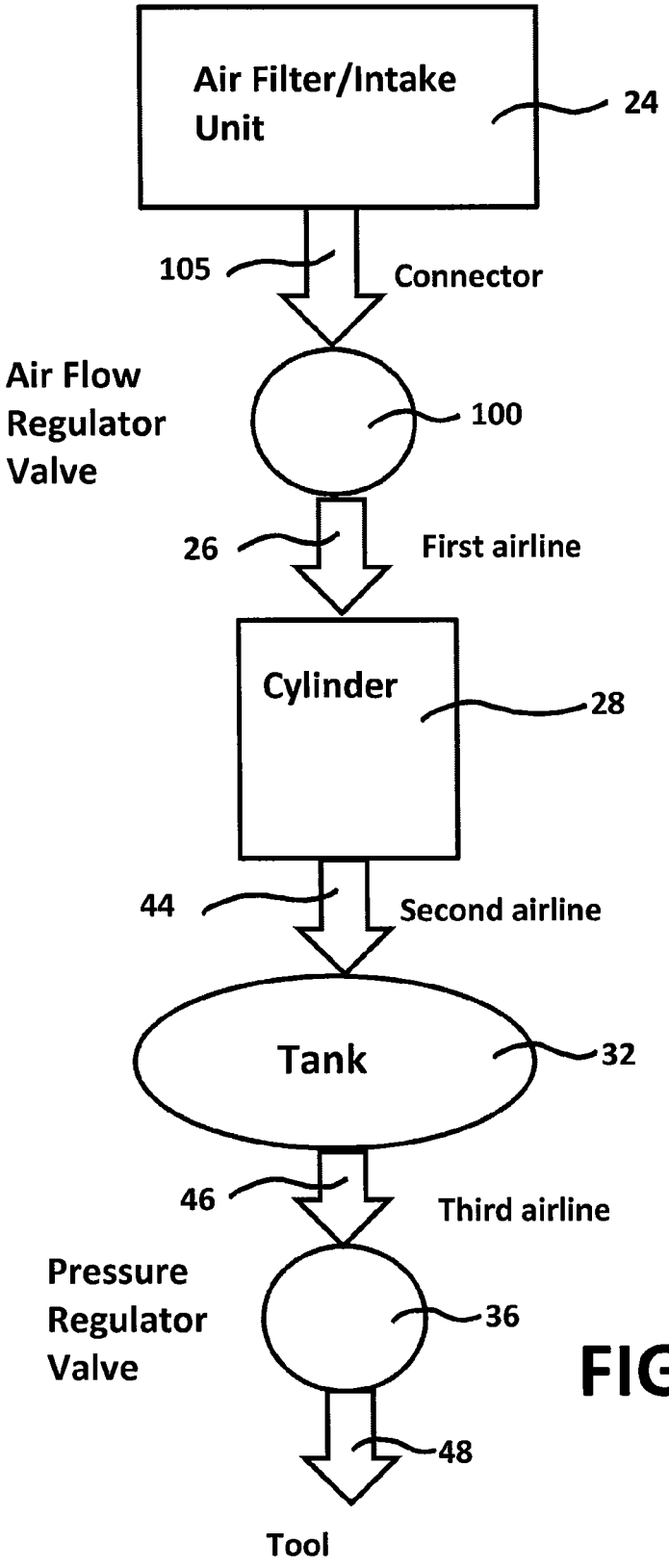
FIG. 4 is a schematic diagram showing the relationship between components of the compressor shown in FIG. 1.

When the compressed air is needed for use in conjunction with a tool, it is allowed to pass from the tanks 32 to a quick coupler outlet 34 via a third airline 46 (schematically shown in FIG. 4). A tool 48 (schematically shown in FIG. 4) may be conveniently connected to the outlet using male and female coupler outlets according to known technology. In some embodiments, the compressor 10 may have more than one outlet 34 in case it is desired to use more than one tool at the same time.

Air is allowed to pass to the outlets 34 from the compressor tanks 32 by adjusting a pressure regulator valve having an adjustment knob 36 on the dashboard 38 of the compressor. Further on the dashboard are two pressure gauges, a tank gauge 40 which measures pressure in the pressure tank 32, and an outlet gauge, which measures pressure at the outlets 34. It will be appreciated that an operator of the compressor will find that knowledge of these two pressures is extremely useful for operating the compressor system.

Figure 2:
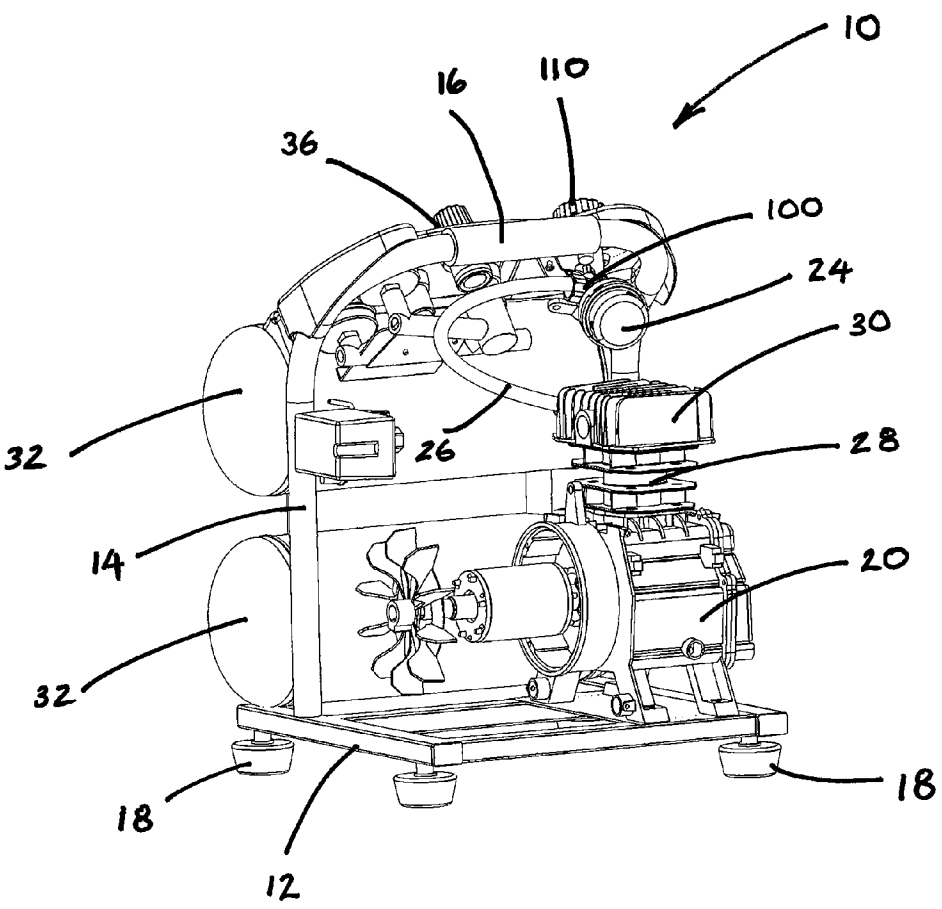
FIG. 2 is a rear perspective view of the portable compressor shown in FIG. 1, with a motor cover removed.
Figure 3:
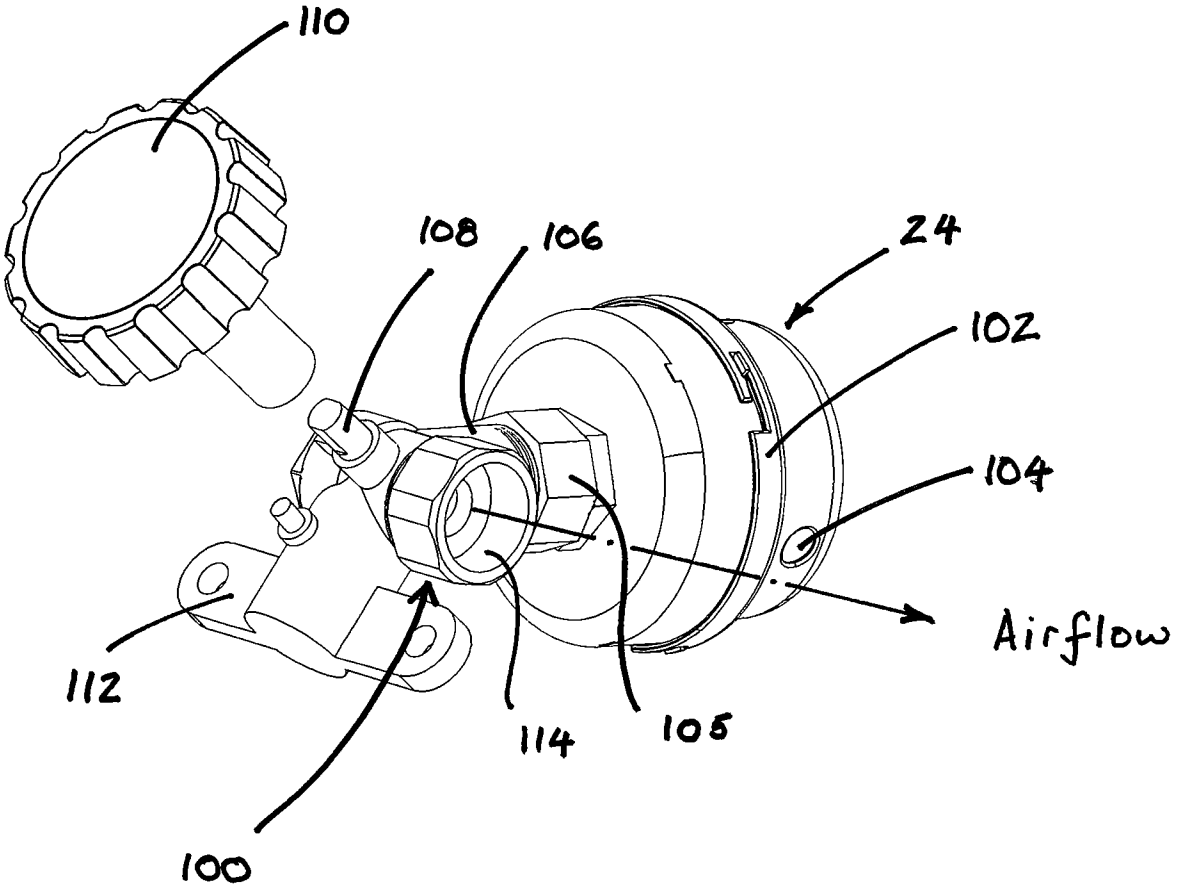
FIG. 3 is a perspective view of components of the portable compressor shown in FIG. 1.

Referring to FIGS. 2-4, and turning now to a novel and advantageous feature of the compressor 10, in one embodiment the invention includes an adjustable air control valve 100, that is inserted into the first airline 26 between the air intake unit 24 and the cylinder 28 for compression. The air flow intake unit 24 includes a filter cover 102 that is removably screwed onto the intake unit 24. The filter cover defines a plurality of intake holes 104 configured to allow air to flow at atmospheric pressure into the unit 24. An inlet connector 105 connects the control valve 100 to the intake unit 24. The control valve 100 comprises a valve unit 106 of known technology which internally defines a throat of certain diameter that may be changed by a mechanism configured to reduce the throat upon rotation of a stem 108. Known valve mechanisms may include a gate valve, a globe valve, a diaphragm valve, a plug valve, a needle valve, or a electro pneumatic valve and the like. The stem 108 is conveniently connected to a valve knob 110 which in some embodiments may be located on the dashboard 38 of the compressor in the assembled condition. An outlet connector 114 is provided to connect the valve 106 up to the first airline 26 which completes the airline between the intake unit 24 and the cylinder 28. (The airline comprises all components transporting air from the inlet 24 to the cylinder 28.)

In use, the control valve 100 provides the following advantage to an operator who is monitoring the compressor for problems such as may arise due to a voltage drop of electric power delivered to the compressor, as described more fully above. For example, the motor may stall, or it may give off audible warning signals that it is about to stall by changing the frequency, and hence the sound, of its operation. Should the operator detect that the motor 20 is becoming unable to deliver sufficient torque to adequately compress the air that is arriving from the inlet 24 and being delivered into the cylinder 28, he may slowly close the valve 100 by manually rotating the knob 110 until the motor reduces signs of distress. This action will not stop the compressor 10 from operating, but it will reduce the rate at which air at atmospheric pressure is being delivered into the cylinder 28 (air pump or compression means). This means that, per unit of time, the piston within the cylinder will have to compress less air for export to the storage tanks 32. This result effectively reduces the load on the motor 20, and the motor will then tend to operate at its design speed of rotation without stalling, while at the same time producing compressed air at a reduced rate. This result is beneficial because it avoids the motor from stalling and stopping, at the acceptable price of taking a little longer time to fill the tanks 32 with air compressed to a desired pressure.

Figure 5:
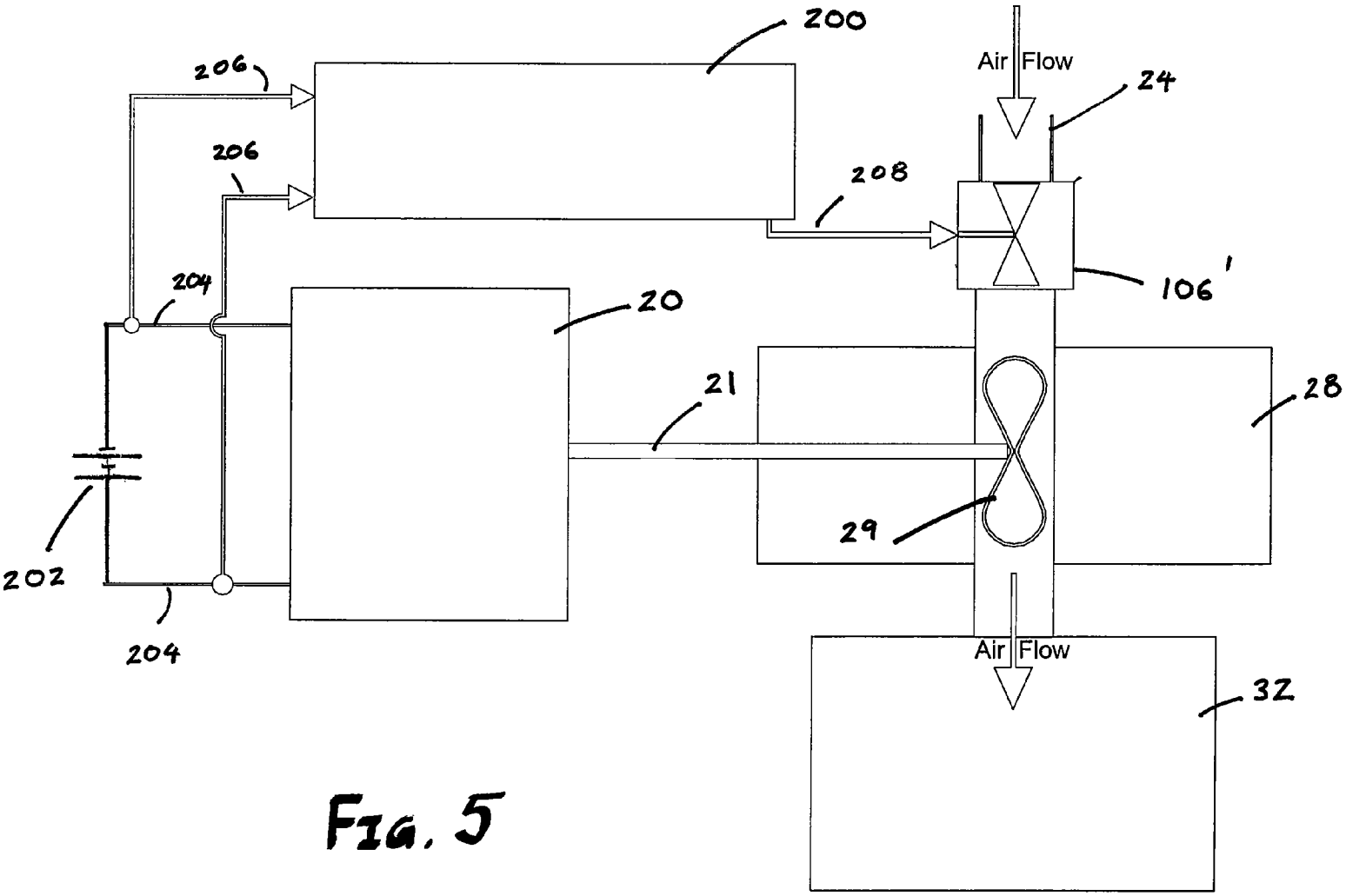
FIG. 5 is a schematic diagram showing features of another embodiment of the invention.

Another embodiment of the invention is described with additional reference to FIG. 5. In this embodiment, the valve 106 of the previous embodiment is replaced with a voltage controlled air valve 106'. In common with the previous embodiment, a supply of potential difference or voltage is supplied to the motor 20 from a power outlet 202 using a cable 204. The motor 20 supplies kinetic energy via a transfer mechanism 21 to a compression means or device 29 which may include a piston oscillating within a cylinder 28. At the point of connection of the cable 204 to the motor 20, the potential difference at the motor is measured using a voltage sensing and amplifier circuit 200 in conjunction with appropriate lead lines 206. This circuit 200 is configured to detect whether the potential difference that is actually available to the motor 20 is less than the rated power at which the motor is designed to operate (typically the same as the potential difference delivered at the power outlet 202), which may be 120 volts in the USA. As explained above, circumstances may be present which cause the potential difference at the point of connection to the motor to fall short of the rated potential difference of the motor 20. Such a difference, or drop, in potential difference may arise from the fact that the length of the cable 204 is excessively long, or from prevailing temperature conditions, as described above. Whatever the cause of the drop in potential difference to the motor, the circuit 200, which may include a micro-processor device, is configured to measure the difference, or voltage drop, between the rated potential difference of the motor 20 (typically 120 volts), and the actual potential difference supplied to the motor. The circuit 200 is configured to amplify this voltage drop and is further configured to input an amplified voltage reflection of the voltage drop via a line 208 into the voltage controlled air valve 106'. The voltage controlled air valve 106' is configured to respond to the signal bearing the information of the voltage drop by closing the throat in the valve by a certain amount based on the voltage drop. Preferably, the amount by which the throat is closed is directly proportional to the voltage drop. Thus, the greater the voltage drop, the greater the amount that the valve closes its throat to slow the passage of air through the valve 106'. By closing the valve, the motor requires less torque to compress the reduced flow of air into the air pump 28 than it would have required to compress air flow at an unreduced flow rate. The certain amount by which the throat is closed based on the measured voltage drop is determined by a process of calibration during design of the voltage controlled air valve 106', during a process in which a correlation is established between the measured voltage drop and the optimal amount by which the throat should be closed so as to reduce the output torque required to compress the reduced volume of air that must be compressed per unit of time. Accordingly, by reducing the air flow through the valve, and hence into the pump 28, the torque load required during compression is reduced, and this allows the motor to operate at reduced potential difference without stalling.

Thus, it has been found that the present invention eliminates at least one of the major problems associated with portable air compressors.

Although preferred illustrative variations of the present invention are described above, it will be apparent to those skilled in the art that various changes and modifications may be made thereto without departing from the invention. For example, it will be appreciated that combinations of the features of different embodiments may be combined to form another embodiment. It is intended in the appended claims to cover all such changes and modifications that fall within the true spirit and scope of the invention.

We claim:

1. An air compressor comprising:

an air intake unit for importing air at atmospheric pressure;

a means for compressing air;

a motor configured to drive the means for compressing air;

a storage tank;

a first airline extending between the air intake unit and the means for compressing air, the first airline being configured to convey air from the air intake unit into the means for compressing air;

a second airline extending between the means for compressing air and the storage tank, the second airline being configured to convey compressed air from the means for compressing air into the storage tank;

a valve inserted into the first airline such that air in the first airline flows through the valve, the valve being configured to be adjustable between a condition of full air flow rate and a condition of reduced air flow rate;

wherein the motor is designed to operate under a rated potential difference, and the valve is configured to be adjustable by a means for adjustment that includes a micro-processing circuit, the means for adjustment being configured to measure a difference between the rated potential difference and an actual potential difference supplied to the motor, the means for adjustment being further configured to reduce a throat in the valve to reduce air flow through the valve by a certain amount, the certain amount being based on the difference between the rated potential difference and the actual potential difference supplied to the motor.

2. A method for providing air to an air compressor having a motor designed to be run under a rated potential difference, the method comprising:

applying a potential difference to the motor thereby running the motor;

drawing air at atmospheric pressure through a valve at a delivery rate of flow;

transmitting the air to a means for compressing air;

compressing the air in the means for compressing air;

transmitting the air from the means for compressing air to a storage tank;

measuring the potential difference applied to the motor;

comparing the measured potential difference with the rated potential difference; and adjusting the valve to decrease the delivery rate of flow;

wherein, adjusting the valve to decrease the delivery rate of flow includes adjusting the rate of flow by an amount that is based on the difference between the rated potential difference and the potential difference supplied to the motor.

3. The method of claim 2, wherein adjusting the valve is performed automatically, by a microprocessor.

* * * * *